US006386727B1

(12) United States Patent
Yeh

(10) Patent No.: US 6,386,727 B1
(45) Date of Patent: May 14, 2002

(54) TOOL HAVING A DETACHABLE LIGHT DEVICE

(76) Inventor: Chang Hsing Yeh, No. 399, Sec. 2, Li Min Road, Taichung (TW), 408

( * ) Notice: Subject to any disclaimer, the term of this patent is extended or adjusted under 35 U.S.C. 154(b) by 5 days.

(21) Appl. No.: 09/590,181

(22) Filed: Jun. 9, 2000

(51) Int. Cl.[7] ..... F21W 111/10

(52) U.S. Cl. ..... 362/119; 362/120; 362/200; 362/199; 362/197

(58) Field of Search ..... 362/119, 120, 362/200, 199, 197; 81/61, 62, 63, 488

(56) References Cited

U.S. PATENT DOCUMENTS 5,899,554 A * 5/1999 Hsu ..... 362/119
5,971,560 A * 10/1999 Chen ..... 362/119
6,116,746 A * 9/2000 Hsu ..... 362/119
6,186,638 B1 * 2/2001 Chang ..... 362/119
6,196,696 B1 * 3/2001 Shiao ..... 362/120
6,224,229 B1 * 5/2001 Lin ..... 362/119
6,238,058 B1 * 5/2001 Lin ..... 362/119

* cited by examiner

*Primary Examiner*—Alan Cariaso
*Assistant Examiner*—Anabel Ton
(74) *Attorney, Agent, or Firm*—Charles E. Baxley

(57) ABSTRACT

A tool includes a handle having a driving stem for driving fasteners. A light device includes a housing having a channel for receiving the handle, a socket received in the housing, a light bulb received in the socket, one or more batteries received in the housing and electrically coupled to the light bulb, and a switch for controlling the energizing of the light bulb. The housing may be attached to the handles of various kinds of tools. The socket is rotatably secured to the housing at a pivot pin for rotating to any suitable angular position relative to the housing.

3 Claims, 3 Drawing Sheets

TOOL HAVING A DETACHABLE LIGHT DEVICE

BACKGROUND OF THE INVENTION

1. Field of the Invention

The present invention relates to a tool, and more particularly to a tool having a detachable light device.

2. Description of the Prior Art

Typical tools comprise a light device engaged therein such that the light device may be used for the tools themselves and may not be disengaged from the tools and may not be attached onto the other tools. One of the typical tools is disclosed in U.S. Pat. No. 5,899,554 to Hsu which also includes a light device solidly retained in the tool handle and may not be disengaged from the tool and may not be changed and attached onto the other tools.

The present invention has arisen to mitigate and/or obviate the afore-described disadvantages of the conventional tools.

SUMMARY OF THE INVENTION

The primary objective of the present invention is to provide a tool including a light device which may be attached onto and disengaged from the tool for allowing the light device to be attached onto various kinds of tools.

In accordance with one aspect of the invention, there is provided a tool comprising a handle including a driving member provided thereon, and a light device including a housing having a channel formed therein for receiving the handle, a socket received in the housing, a light bulb received in the socket, at least one battery received in the housing and electrically coupled to the light bulb, and means for controlling an energizing of the light bulb. The housing of the light device may be attached to the handles of various kinds of tools when required and may be easily changed to the handles of the other tools.

The socket is pivotally secured to the housing at a pivot pin such that the socket may be rotatably secured to the housing and may be rotated to any suitable angular position relative to the housing when required. The housing includes at least one orifice formed therein, the socket includes the pin extended therefrom and engaged into the orifice of the housing for pivotally securing the socket to the housing and for allowing the socket to be rotated relative to the housing to any required angular position.

The socket is made of conductive material and includes a hole formed therein for receiving the light bulb, the light bulb includes a center electrode extended outward of the socket for coupling to the battery by the other conductors. The case electrode of the light bulb is electrically coupled to the socket. A transparent cap is further engaged onto the socket for shielding and for retaining the light bulb in the socket.

The battery includes a center electrode and a case electrode, the light device further includes a bar engaged in the housing, a first conductor secured to the bar and electrically coupled between the light bulb and the center electrode of the battery, a second conductor secured to the bar and electrically coupled between the light bulb and the case electrode of the battery, and switch means for selectively energizing the light bulb.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
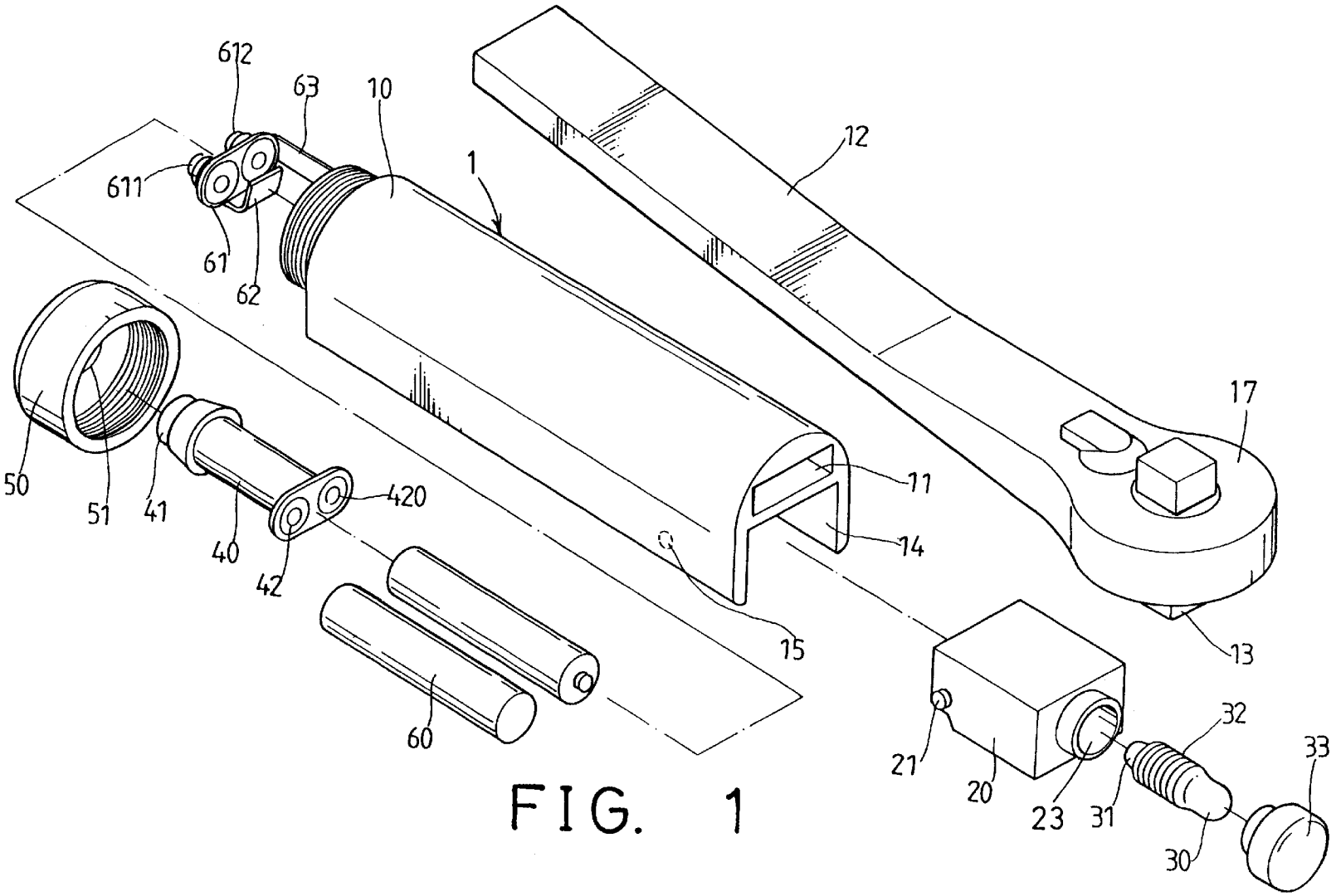
FIG. 1 is an exploded view of a tool having a light device in accordance with the present invention.
Figure 2:
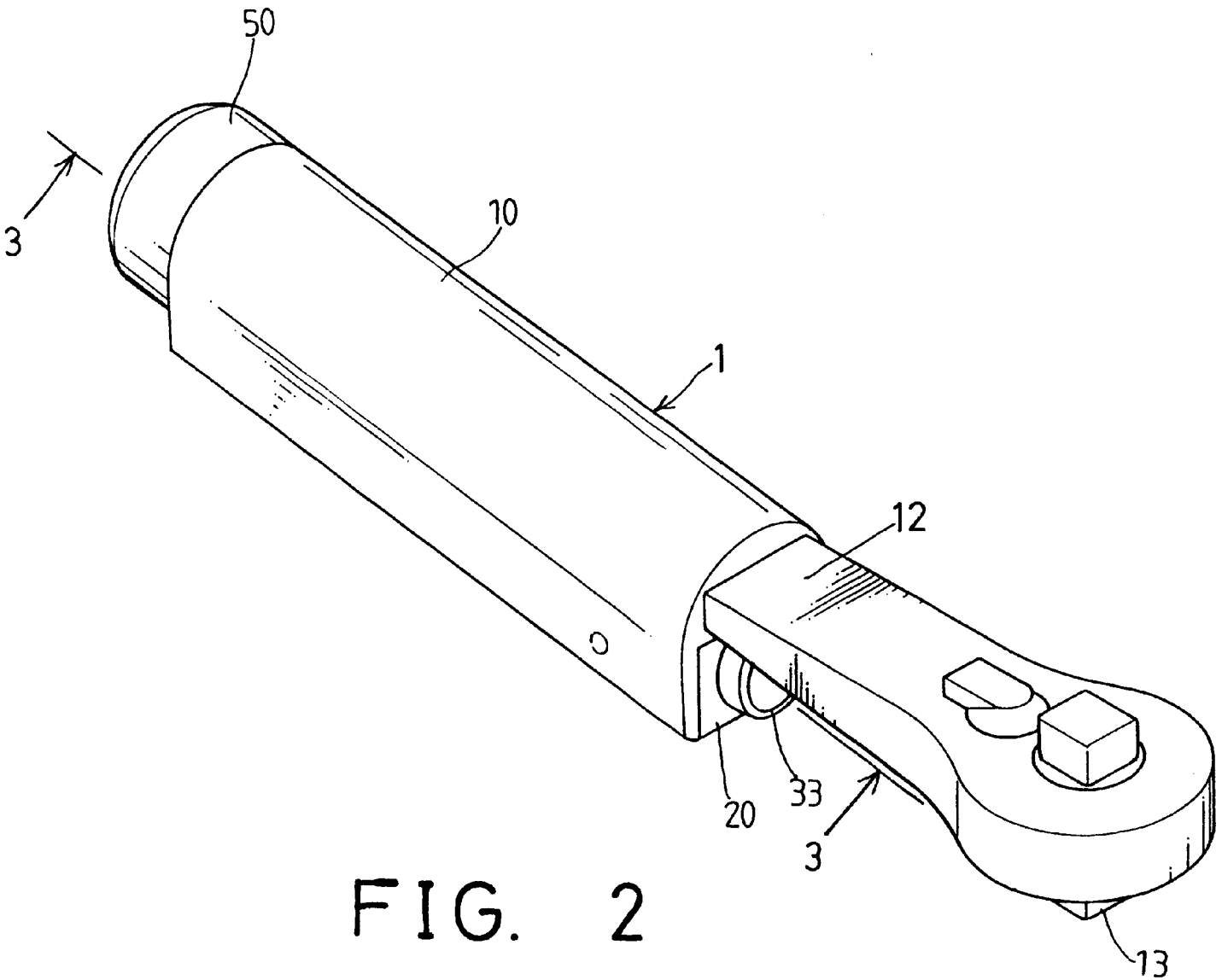
FIG. 2 is a perspective view of the tool.
Figure 3:
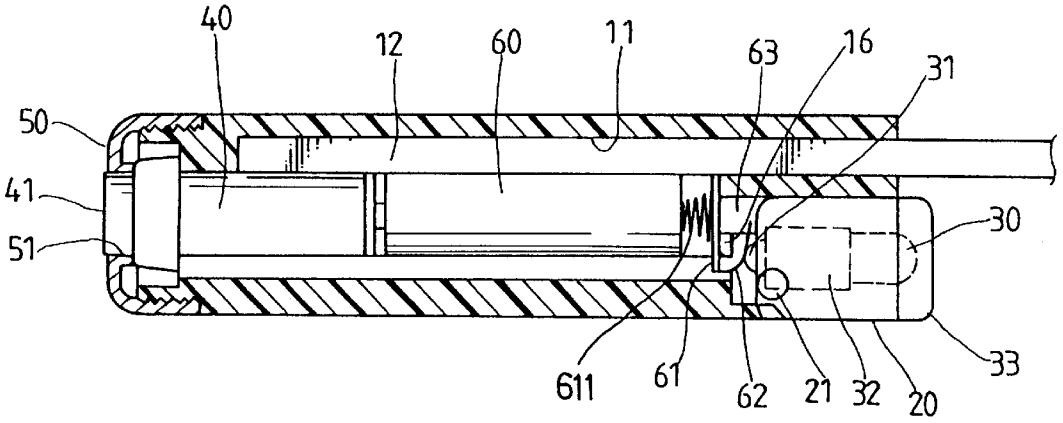
FIG. 3 is a cross sectional view taken along lines 3—3 of FIG. 2.

Referring to the drawings, and initially to FIGS. 1–3, a tool in accordance with the present invention comprises a handle 12 including a driving member, such as a ratchet driving member 13 provided in one end thereof, particularly provided in an end head 17 thereof for driving the fasteners or the like. A light device 1 is designed to be attached onto and to be disengaged from the tool handle 12 when required, such that the light device 1 may be attached onto various kinds of tools.

The light device 1 includes a housing 10 having a channel 11 formed therein for receiving the handle 12 and for allowing the light device 1 to be attached onto and to be disengaged from the tool handle 12 when required. The housing 10 may be secured onto the handle 12 with such as the force-fitted engagement or by the other fasteners. The housing 10 includes a chamber 18 formed therein for receiving one or more batteries 60 therein. The housing 10 includes an opening 14 formed in the front portion thereof and communicating with the chamber 18 of the housing 10, and includes a pair of orifices 15 formed therein and communicating with the opening 14 of the housing 10.

A bar 61 is received in the chamber 18 of the housing 10. The housing 10 may include a partition or a stop 16 (FIGS. 3, 4) provided therein or extended inward of the chamber 18 thereof for engaging with and for retaining the bar 61 within the chamber 18 of the housing 10. The bar 61 includes two conductors, such as the coil springs 611, 612 attached thereon and electrically coupled to the case electrode and the center electrode of the batteries 60 respectively, for example, and bar 61 includes two further conductors 62, 63 attached thereon and coupled to the conductors 611, 612 respectively. The conductor 62 is a bent and resilient spring blade, and the other conductor 63 is a conductor arm secured to and extended from the bar 61 and electrically coupled to the conductor 612, for example.

Figure 4:
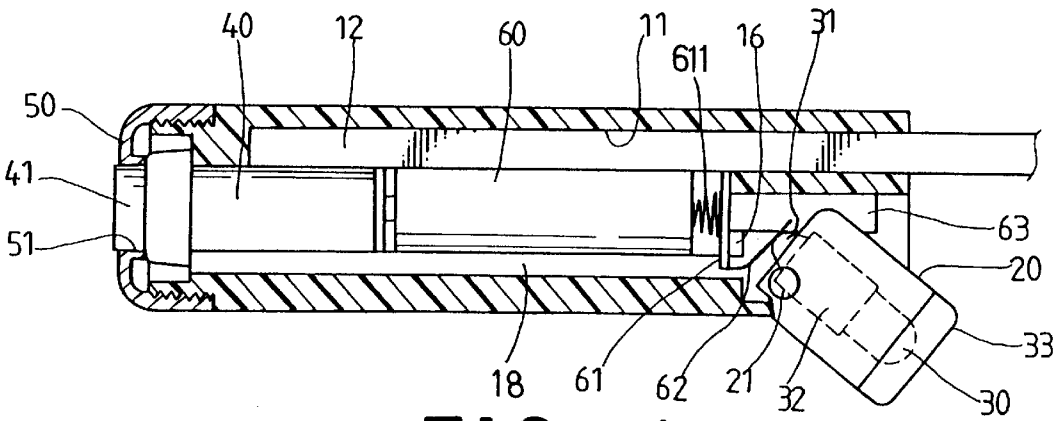
FIG. 4 is a cross sectional view similar to FIG. 3, illustrating the operation of the light device for the tool.

A conductive socket 20 includes one or more pins 21 extended therefrom and engaged in the orifices 15 of the housing 10 for pivotally securing the conductive socket 20 to the housing 10 at the pivot pin(s) 21. The socket 20 includes a hole 23 formed therein for receiving a light bulb 30 therein, such as a light emitting diode or a liquid crystal display. The light bulb 30 includes a case electrode 32 electrically connected with the socket 20, and includes a center electrode 31 extended outward of the socket 20 for engaging with the conductor 62 (FIGS. 3, 4). The socket 20 is engaged with and electrically coupled to the conductor 63 even when the socket 20 is rotated relative to the housing 10 about the pivot pin 21 (FIGS. 3, 4). A cap 33, particularly a transparent cap 33, is secured to the socket 20 for shielding or for retaining the light bulb 30 within the socket 20.

A switch 40 is received in the rear portion of the housing 10 and includes one or more conductors 42, 420 electrically coupled to the electrodes of the batteries 60. The switch 40 includes a depressible button 41 provided in the rear end thereof and extended outward of the housing 10 for actuating or for controlling the energizing of the light bulb 30. A cover 50 is secured to the rear end of the housing 10, by such as a threading engagement, and includes an aperture 51 formed therein for receiving the button 41 and for allowing the button 41 to be extended outward of the cover 50 and for allowing the button 41 to be depressed by the users in order to control the energizing of the light bulb 30.

As shown in the drawings, the case electrode 32 of the light bulb 30 is electrically coupled to the socket 20 which is electrically coupled to the conductors 63, 612 and thus coupled to the batteries 60. The center electrode 31 of the light bulb 30 is electrically coupled to the conductors 62, 611 which are electrically coupled to the batteries 60. The switch 40 is coupled between the center electrode and the case electrode of the batteries 60 for selectively and electrically coupling the center electrode and the case electrode of the batteries 60 together in order to control the energizing the light bulb 30. Alternatively, the tool may include a single battery electrically coupled to the center electrode 31 and the case electrode 32 of the light bulb 30 respectively. The switch 40 is also electrically coupled between the center electrode and the case electrode of the single battery 60 for controlling the energizing the light bulb 30.

Accordingly, the tool in accordance with the present invention includes a light device which may be attached onto and disengaged from the tool for allowing the light device to be attached onto various kinds of tools.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a) a handle including a driving member provided thereon, and b) a light device including:

i) a housing having a channel formed therein for receiving said handle, ii) a socket received in said housing, and pivotally secured to said housing with a pivot pin, for allowing said socket to be rotated relative to said housing about said pivot pin, said socket being conductive and including a hole formed therein, iii) a light bulb received in said hole of said socket, said light bulb including a case electrode electrically coupled to said socket, and including a center electrode extended outward of said socket, iv) at least one battery received in said housing and including a center electrode and a case electrode, v) a bar engaged in said housing, vi) a first conductor secured to said bar and electrically coupled between said light bulb and said center electrode of said at least one battery, vii) a second conductor secured to said bar and electrically coupled between said light bulb and said case electrode of said at least one battery, and viii) switch means for selectively energizing said light bulb.

2. The tool according to claim 1 further comprising a transparent cap engaged onto said socket for retaining said light bulb in said socket.

3. The tool according to claim 1, wherein said second conductor is a resilient spring blade having a first end electrically coupled to said case electrode of said at least one battery, and having a second end for selectively engaging with said center electrode of said light bulb when said light bulb and said socket are rotated relative to said housing.

* * * * *